US006713737B1

(12) United States Patent
Verhagen

(10) Patent No.: US 6,713,737 B1
(45) Date of Patent: Mar. 30, 2004

(54) SYSTEM FOR REDUCING NOISE FROM A THERMOCOUPLE IN AN INDUCTION HEATING SYSTEM

(75) Inventor: Paul D. Verhagen, Appleton, WI (US)

(73) Assignee: Illinois Tool Works Inc., Glenview, IL (US)

( * ) Notice: Subject to any disclaimer, the term of this patent is extended or adjusted under 35 U.S.C. 154(b) by 233 days.

(21) Appl. No.: 09/995,106

(22) Filed: Nov. 26, 2001

(51) Int. Cl.[7] ..... H05B 6/06

(52) U.S. Cl. ..... 219/667; 219/668; 361/103; 374/141

(58) Field of Search ..... 219/667, 665, 219/666, 668, 663, 494, 510; 361/103, 106, 212, 220; 374/141

(56) References Cited

U.S. PATENT DOCUMENTS

| | | | | | |
|---|---|---|---|---|---|
| 2,457,843 | A | | 1/1949 | Strickland, Jr. | 174/47 |
| 2,483,301 | A | | 9/1949 | Roberds | 174/15 |
| 2,817,066 | A | | 12/1957 | Scarpa | 336/84 |
| 2,988,804 | A | | 6/1961 | Tibbetts | 29/155.57 |
| 3,022,368 | A | | 2/1962 | Miller | 174/15 |
| 3,492,453 | A | | 1/1970 | Hurst | 219/10.49 |
| 3,535,597 | A | | 10/1970 | Kendrick | 317/155.5 |
| 3,667,476 | A | * | 6/1972 | Muller | 607/96 |
| 3,764,725 | A | | 10/1973 | Kafka | 174/15 |
| 3,946,349 | A | | 3/1976 | Haldeman, III | 336/62 |
| 4,317,979 | A | | 3/1982 | Frank et al. | 219/10.77 |
| 4,339,645 | A | | 7/1982 | Miller | 219/10.49 |
| 4,355,222 | A | | 10/1982 | Geithman et al. | 219/10.57 |
| 4,392,040 | A | | 7/1983 | Rand et al. | 219/10.71 |
| 4,527,032 | A | | 7/1985 | Young et al. | 219/10.61 |
| 4,527,550 | A | | 7/1985 | Ruggera et al. | 128/1.5 |
| 4,549,056 | A | | 10/1985 | Okatsuka et al. | 219/10.77 |
| 4,578,552 | A | | 3/1986 | Mortimer | 219/10.41 |
| 4,595,814 | A | * | 6/1986 | Ogino et al. | 219/664 |
| 4,761,528 | A | | 8/1988 | Caillaut et al. | 219/10.491 |
| 4,794,220 | A | | 12/1988 | Sekiya | 219/10.491 |
| 4,900,885 | A | | 2/1990 | Inumada | 219/10.55 B |
| 4,942,279 | A | | 7/1990 | Ikeda | 219/10.75 |
| 4,963,694 | A | | 10/1990 | Alexion et al. | 174/15.6 |
| 4,975,672 | A | | 12/1990 | McLyman | 336/198 |
| 5,004,865 | A | | 4/1991 | Krupnicki | 174/15.7 |
| 5,101,086 | A | | 3/1992 | Dion et al. | 219/10.491 |
| 5,113,049 | A | | 5/1992 | Border et al. | 219/10.79 |
| 5,185,513 | A | | 2/1993 | Pacileo | 219/497 |
| 5,313,037 | A | | 5/1994 | Hansen et al. | 219/632 |
| 5,343,023 | A | | 8/1994 | Geissler | 219/661 |
| 5,449,234 | A | * | 9/1995 | Gipp et al. | 374/185 |
| 5,461,215 | A | | 10/1995 | Haldeman | 219/677 |
| 5,504,309 | A | | 4/1996 | Geissler | 219/663 |
| 5,708,253 | A | | 1/1998 | Bloch et al. | 219/130.01 |
| 6,043,471 | A | | 3/2000 | Wiseman et al. | 219/662 |
| 6,124,581 | A | | 9/2000 | Ulrich | 219/665 |

OTHER PUBLICATIONS

Mannings U.S.A. Brochure—"Induction Bolt Heating Services".

(List continued on next page.)

*Primary Examiner*—Philip H. Leung
(74) *Attorney, Agent, or Firm*—Fletcher Yoder

(57) ABSTRACT

A method and apparatus for reducing electrical noise in an electrical signal from a temperature feedback device to an induction heating system. The induction heating system has an electrical connector that is adapted to electrically couple a temperature feedback device to a system controller and to ground via a capacitor circuit. The capacitor circuit shunts electrical noise to ground but allows a temperature signal from the temperature feedback device to be received by the system controller. A shielded extension cable to electrically couple the temperature feedback device to an induction heating system may be used. The shielding of the extension cable is electrically coupled to ground.

19 Claims, 7 Drawing Sheets

U.S. PATENT DOCUMENTS

| | | | | |
|---|---|---|---|---|
| 6,229,126 | B1 | 5/2001 | Ulrich et al. | 219/635 |
| 6,265,701 | B1 | 7/2001 | Bickel et al. | 219/617 |
| 6,316,755 | B1 | 11/2001 | Ulrich | 219/665 |
| 6,346,690 | B1 | 2/2002 | Ulrich et al. | 219/635 |

OTHER PUBLICATIONS

Superheat Services, Inc. Brochure—"On Site Heat Treatment Specialists".

400 Cycle Induction Heating with proportional control for Preheating and Stress Relieving or Welding Joints, Hobart Brothers Co.

Installation, Operation, and Maintenance for High Frequency Induction Heaters, Hobart Brothers Co.

* cited by examiner

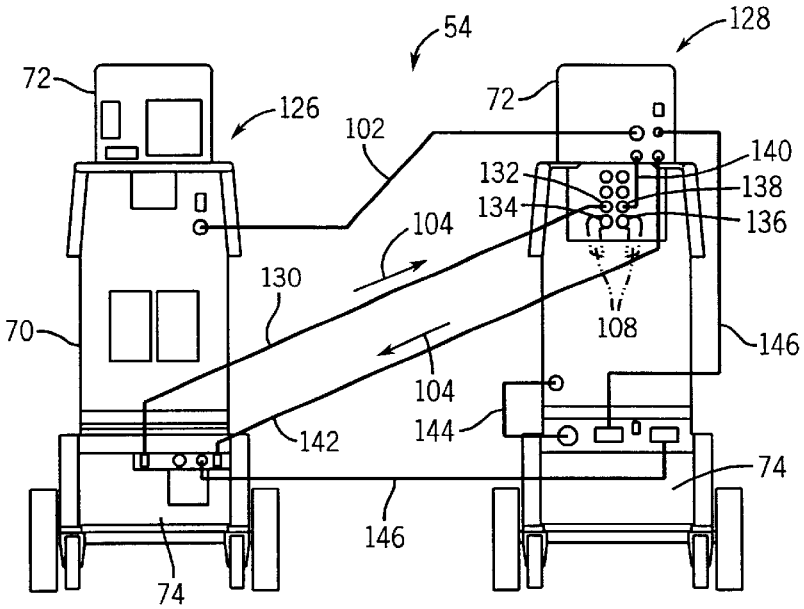
FIG. 5
FIG. 11
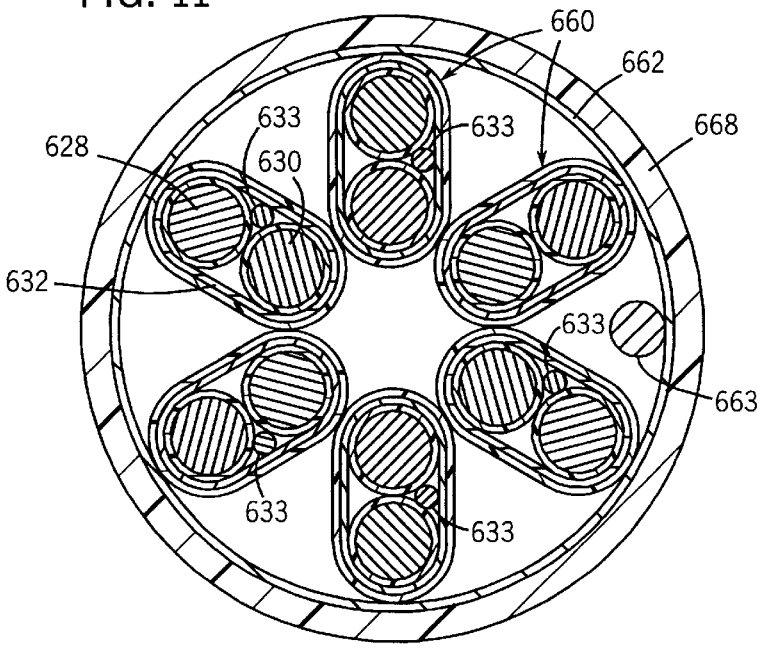

SYSTEM FOR REDUCING NOISE FROM A THERMOCOUPLE IN AN INDUCTION HEATING SYSTEM

FIELD OF THE INVENTION

The present invention relates generally to induction heating, and particularly to a method and apparatus for inductively heating a workpiece using a thermocouple to indicate workpiece temperature.

BACKGROUND OF THE INVENTION

Induction heating is a method of heating a workpiece. Induction heating involves applying an AC electric signal to a conductor adapted to produce a magnetic field, such as a loop or coil. The alternating current in the conductor produces a varying magnetic flux. The conductor is placed near a metallic object to be heated so that the magnetic field passes through the object. Electrical currents are induced in the metal by the magnetic flux. The metal is heated by the flow of electricity induced in the metal by the magnetic field.

Typically, induction heating systems are designed to heat a workpiece to a desired temperature and maintain the workpiece at that temperature for a desired period of time. Temperature feedback devices, such as thermocouples, are used to provide the system with an electrical signal corresponding to the temperature of the workpiece. Thermocouples typically consist of two dissimilar metals that produce a voltage between the two metals that varies according to the temperature of the two metals. The voltage difference between the two metals is used to produce a signal that is representative of the temperature of the workpiece. In an induction heating system, at least one thermocouple is typically placed on a workpiece in close proximity to the area being heated. Electrical conductors are used to couple the thermocouple to a controller that is used to control the operation of the induction heating system. However, the thermocouple and electrical conductors are susceptible to picking up electrical noise and transmitting the noise, as well as the temperature signal produced by the thermocouple, to the controller. The electrical noise distorts the thermocouple signal, which may result in improper heating of the workpiece or in the recordation of incorrect temperature data.

Electrical noise may be produced by several potential sources. For example, electrical noise may be produced by the varying magnetic field produced by an induction coil placed around a workpiece. Additionally, electrical noise may be produced by the power source in the induction heating system. The arc produced by an electric arc welder may also produce electrical noise that may be transmitted to the thermocouple and conductors. Radios in the vicinity of the workpiece may also produce electrical noise that may interfere with the signal produced by a thermocouple.

There is a need therefore for an induction heating system that avoids the problems associated with current temperature sensing means and methods. Specifically, there is a need for an induction heating system that reduces or eliminates electrical noise in the electrical signal generated by a temperature feedback device, such as a thermocouple.

SUMMARY OF THE INVENTION

The present technique provides novel inductive heating components, systems, and methods designed to respond to such needs. An induction heating system is featured according to one aspect of the present technique. The induction heating system has an electrical connector that is adapted to electrically couple a temperature feedback device to a system controller. In addition, the electrical connector couples the temperature feedback device to ground via a capacitor circuit. The capacitor circuit shunts electrical noise to ground. However, the capacitor circuit allows temperature signals from the temperature feedback device to be conducted to the controller and a data recorder, if used.

According to another aspect of the present technique, a shielded extension cable is provided to electrically couple a temperature feedback device to an induction heating system. The shielded extension cable has conductive shielding that surrounds a plurality of conductors. The plurality of conductors are used to conduct a signal representative of temperature from the temperature feedback device to the system. The shielding is electrically coupled to ground to conduct electrical noise, such as voltage spikes, to ground.

According to another aspect of the present technique, a shielded extension cable is provided that is operable to electrically couple a plurality of temperature feedback devices, such as thermocouples, to an induction heating system. Each of the temperature feedback devices is coupled through a separate group of conductors. The shielded extension cable has shielding that surrounds each of the separate groups of conductors. The shielding is electrically coupled to ground to conduct electrical noise, such as voltage spikes, to ground.

BRIEF DESCRIPTION OF THE DRAWINGS

The invention will hereafter be described with reference to the accompanying drawings, wherein like reference numerals denote like elements, and:

FIG. 5 is an elevational drawing illustrating the front and the rear of an induction heating system, according to an exemplary embodiment of the present technique;

FIG. 11 is a cross-sectional view of the shielded extension multi-thermocouple cable, taken generally along line 11—11 of FIG. 10.

DETAILED DESCRIPTION OF THE PREFERRED EMBODIMENTS

Referring generally to FIGS. 1–5, an induction heating system 50 for applying heat to a workpiece 52 is illustrated.

Figure 1:
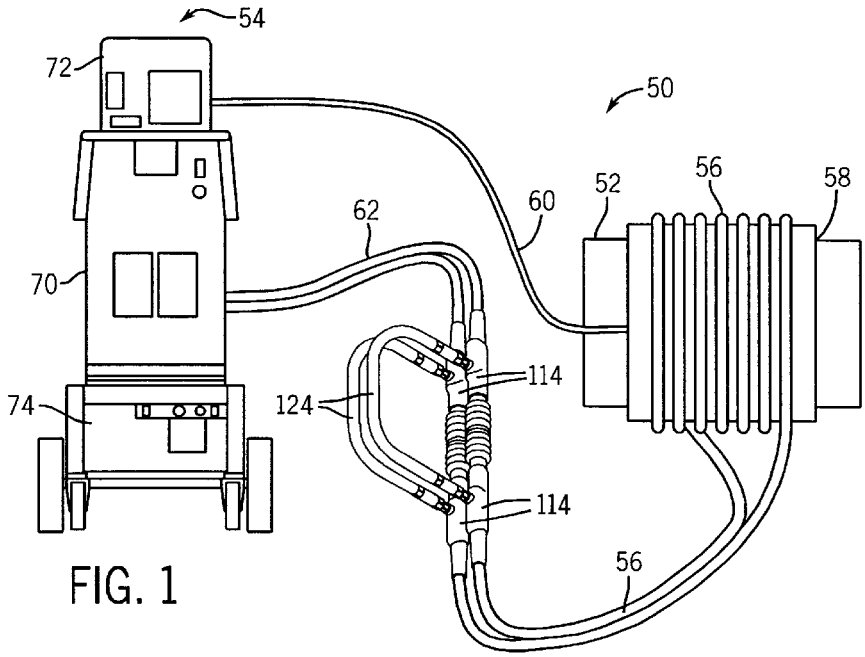
FIG. 1 is an induction heating system, according to an exemplary embodiment of the present technique.

In the illustrated embodiment, the workpiece 52 is a circular pipe. However, the workpiece 52 may have a myriad of shapes and compositions. As best illustrated in FIG. 1, the induction heating system 50 comprises a power system 54, a flexible fluid-cooled induction heating cable 56, an insulation blanket 58, at least one temperature feedback device 60, and an extension cable 62. The extension cable 62 is used to extend the effective distance of the fluid-cooled induction heating cable 56 from the power system 54. The power system 54 produces a flow of AC current through the extension cable 62 and fluid-cooled induction heating cable 56. Additionally, the power system provides a flow of cooling fluid through the extension cable 62 and fluid-cooled induction heating cable 56. In FIG. 1, the fluid-cooled induction heating cable 56 has been wrapped around the workpiece 52 several times to form a series of loops.

Figure 2:
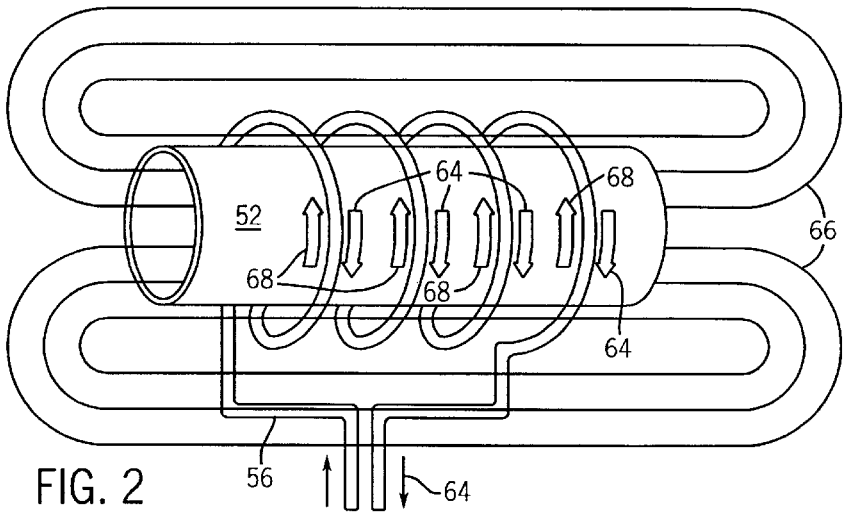
FIG. 2 is a diagram of the process of inducing heat in a workpiece using an induction heating system, according to an exemplary embodiment of the present technique.

As best illustrated in FIG. 2, the AC current 64 flowing through the fluid-cooled induction heating cable 56 produces a magnetic field 66. The magnetic field 66, in turn, induces a flow of current 68 in the workpiece 52. The induced current 68 produces heat in the workpiece 52. Referring again to FIG. 1, the insulation blanket 58 forms a barrier to reduce the loss of heat from the workpiece 56 and to protect the fluid-cooled induction heating cable 56 from heat damage. The fluid flowing through the fluid-cooled induction heating cable 56 also acts to protect the fluid-cooled induction heating cable 56 from heat damage due to the temperature of the workpiece 52 and electrical current flowing through the conductors in the fluid-cooled induction heating cable. The temperature feedback device 60 provides the power system 54 with temperature information from the workpiece 52.

Referring again to FIG. 1, in the illustrated embodiment, the power system 54 comprises a power source 70, a controller 72, and a cooling unit 74. The power source 70 produces the AC current that flows through the fluid-cooled induction heating cable 56. In the illustrated embodiment, the controller 72 controls the operation of the power source 70 in response to programming instructions and the workpiece temperature information received from the temperature feedback device 60. The cooling unit 74 is operable to provide a flow of cooling fluid through the fluid-cooled induction heating cable 56 to remove heat from the fluid-cooled induction heating cable 56.

Figure 3:
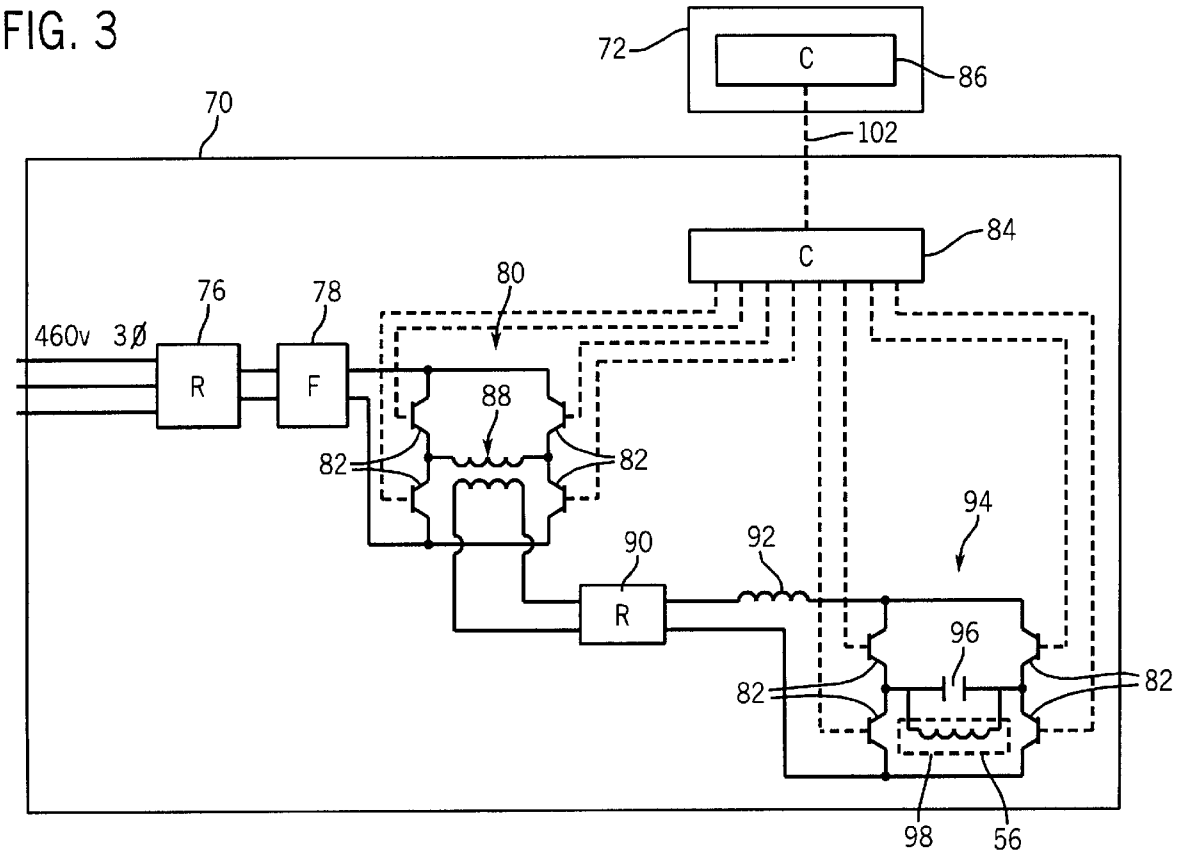
FIG. 3 is an electrical schematic diagram of an induction heating system, according to an exemplary embodiment of the present technique.

Referring generally to FIG. 3, an electrical schematic of a portion of the system 50 is illustrated. In the illustrated embodiment, 460 Volt, 3-phase AC input power is coupled to the power source 70. A rectifier 76 is used to convert the AC power into DC power. A filter 78 is used to condition the rectified DC power signals. A first inverter circuit 80 is used to invert the DC power into desired AC output power. In the illustrated embodiment, the first inverter circuit 80 comprises a plurality of electronic switches 82, such as IGBTs. Additionally, in the illustrated embodiment, a controller board 84 housed within the power source 70 controls the electronic switches 82. A controller board 86 within the controller 72 in turn, provides signals to control the controller board 84 in the power source 70.

A step-down transformer 88 is used to couple the AC output from the first inverter circuit 80 to a second rectifier circuit 90, where the AC is converted again to DC. In the illustrated embodiment, the DC output from the second rectifier 90 is, approximately, 600 Volts and 50 Amps. An inductor 92 is used to smooth the rectified DC output from the second rectifier 90. The output of the second rectifier 90 is coupled to a second inverter circuit 94. The second inverter circuit 94 steers the DC output current into high-frequency AC signals. A capacitor 96 is coupled in parallel with the fluid-cooled induction heating cable 56 across the output of the second inverter circuit 94. The fluid-cooled induction heating cable 56, represented schematically as an inductor 98, and capacitor 96 form a resonant tank circuit. The capacitance and inductance of the resonant tank circuit establishes the frequency of the AC current flowing through the fluid-cooled induction heating cable 56. The inductance of the fluid-cooled induction heating cable 56 is influenced by the number of turns of the heating cable 56 around the workpiece 52. The current flowing through the fluid-cooled induction heating cable 56 produces a magnetic field that induces current flow, and thus heat, in the workpiece 52.

Figure 4:
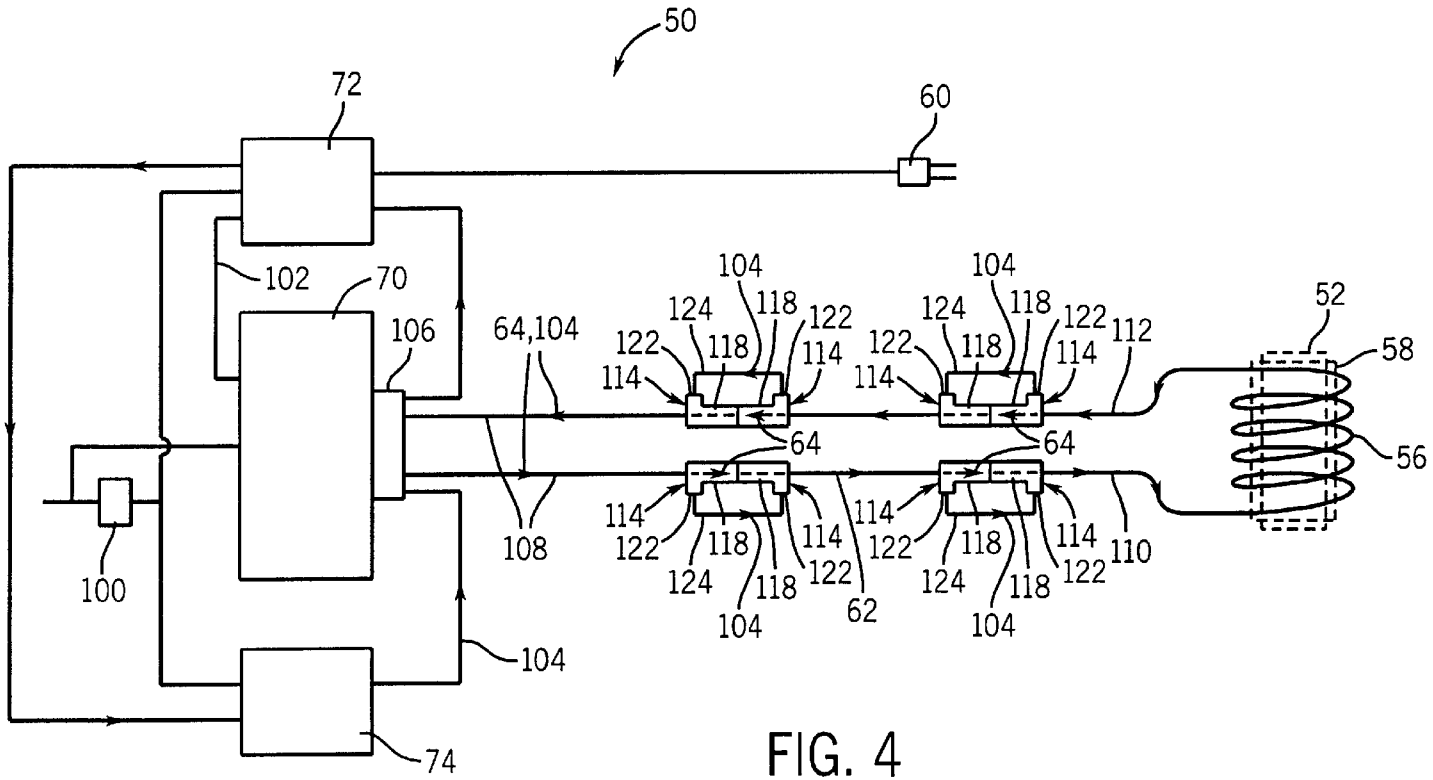
FIG. 4 is a schematic diagram of a system for inductively heating a workpiece, according to an exemplary embodiment of the present technique.

Referring generally to FIG. 4, an electrical and fluid schematic of the induction heating system 50 is illustrated. In the illustrated embodiment, 460 Volt, 3-phase AC input power is supplied to the power source 70 and to a step-down transformer 100. In the illustrated embodiment, the step-down transformer 100 produces a 115 Volt output applied to the fluid cooling unit 74 and to the controller 72. The step-down transformer 100 may be housed separately or within one of the other components of the system 50, such as the fluid cooling unit 74. A connector cable 102 is used to electrically couple the controller 72 and the power source 70. As discussed above, the power source 70 provides a high-frequency AC power output, such as radio frequency AC signals, to the heating cable 56. In the illustrated embodiment, cooling fluid 104 from the cooling unit 74 flows to an output block 106. The cooling fluid 104 may be water, anti-freeze, etc. Additionally, the cooling fluid 104 may be provided with an anti-fungal or anti-bacterial solution. The cooling fluid 104 flows from the cooling unit 74 to the output block 106. Electrical current 64 from the power source 70 also is coupled to the output block 106.

In the illustrated embodiment, an output cable 108 is connected to the output block 106. The output cable 108 couples cooling fluid and electrical current to the extension cable 62. The extension cable 62, in turn, couples cooling fluid 104 and electrical current 64 to the fluid-cooled induction heating cable 56. In the illustrated embodiment, cooling fluid 104 flows from the output block 106 to the fluid-cooled induction heating cable 56 along a supply path 10 through the output cable 108 and the extension cable 62. The cooling fluid 104 returns to the output block 106 from the fluid-cooled induction heating cable 56 along a return path 112 through the extension cable 62 and the output cable 108. AC electric current 64 also flows along the supply and return paths. The AC electric current 64 produces a magnetic field that induces current, and thus heat, in the workpiece 52. Heat in the heating cable 56, produced either from the workpiece 52 or by the AC electrical current flowing through conductors in the heating cable 56, is carried away from the heating cable 56 by the cooling fluid 104. Additionally, the insulation blanket 58 forms a barrier to reduce the transfer of heat from the workpiece 52 to the heating cable 56.

Referring generally to FIGS. 1 and 4, in the illustrated embodiment, the fluid-cooled induction heating cable 56 has a connector assembly 114. The extension cable 62 also has a pair of connector assemblies 114. Each connector assembly 114 is adapted for mating engagement with another connector assembly 114. In the illustrated embodiment, each connector assembly separately couples electricity and cooling fluid. The connector assemblies are electrically coupled by connecting an electrical connector 118 in one connector assembly 114 with an electrical connector 118 in a second connector assembly 114. Each of the connector assemblies 114 also has a hydraulic fitting 122. The connector assemblies 114 are fluidicly coupled by routing a jumper 124 from the hydraulic fitting 122 in one connector assembly 114 to the hydraulic fitting 122 in a second connector assembly 114. Electrical current 64 flows through the electrical connectors 118 and fluid 104 flows through the hydraulic fittings 122 and jumper 124. In the illustrated embodiment, cooling fluid 104 from the heating cable 56 is then coupled to the controller 72. Cooling fluid flows from the controller 72 back to the cooling unit 74. The cooling unit 74 removes heat in the cooling fluid 104 from the heating cable 56. The cooled cooling fluid 104 is then supplied again to the heating cable 56.

FIG. 5 illustrates front and rear views of a power system 54. In the illustrated embodiment, the front side 126 of the power system 54 is shown on the left and the rear side 128 of the power system 54 is shown on the right. A first hose 130 is used to route fluid 104 from the front of the cooler 74 to a first terminal 132 of the output block 106 on the rear of the power source 70. The first terminal 132 is fluidicly coupled to a second terminal 134 of the output block 106. The output cable 108 is connected to the second terminal 134 and a third terminal 136. The second and third terminals are operable to couple both cooling fluid and electric current to the output cable 108. Supply fluid flows to the heating cable 56 through the second terminal 134 and returns from the heating cable 56 through the third terminal 136. The third terminal 136 is, in turn, fluidicly coupled to a fourth terminal 138. A second hose 140 is connected between the fourth terminal 138 and the controller 72. A third hose 142 is connected between the controller 72 and the cooling unit 74 to return the cooling fluid to the cooling unit 74, so that heat may be removed. An electrical jumper cable 144 is used to route 460 Volt, 3-phase power to the power source 70. Various electrical cables 146 are provided to couple 115 Volt power from the step-down transformer 100 to the controller 72 and the cooling unit 74.

Figure 6:
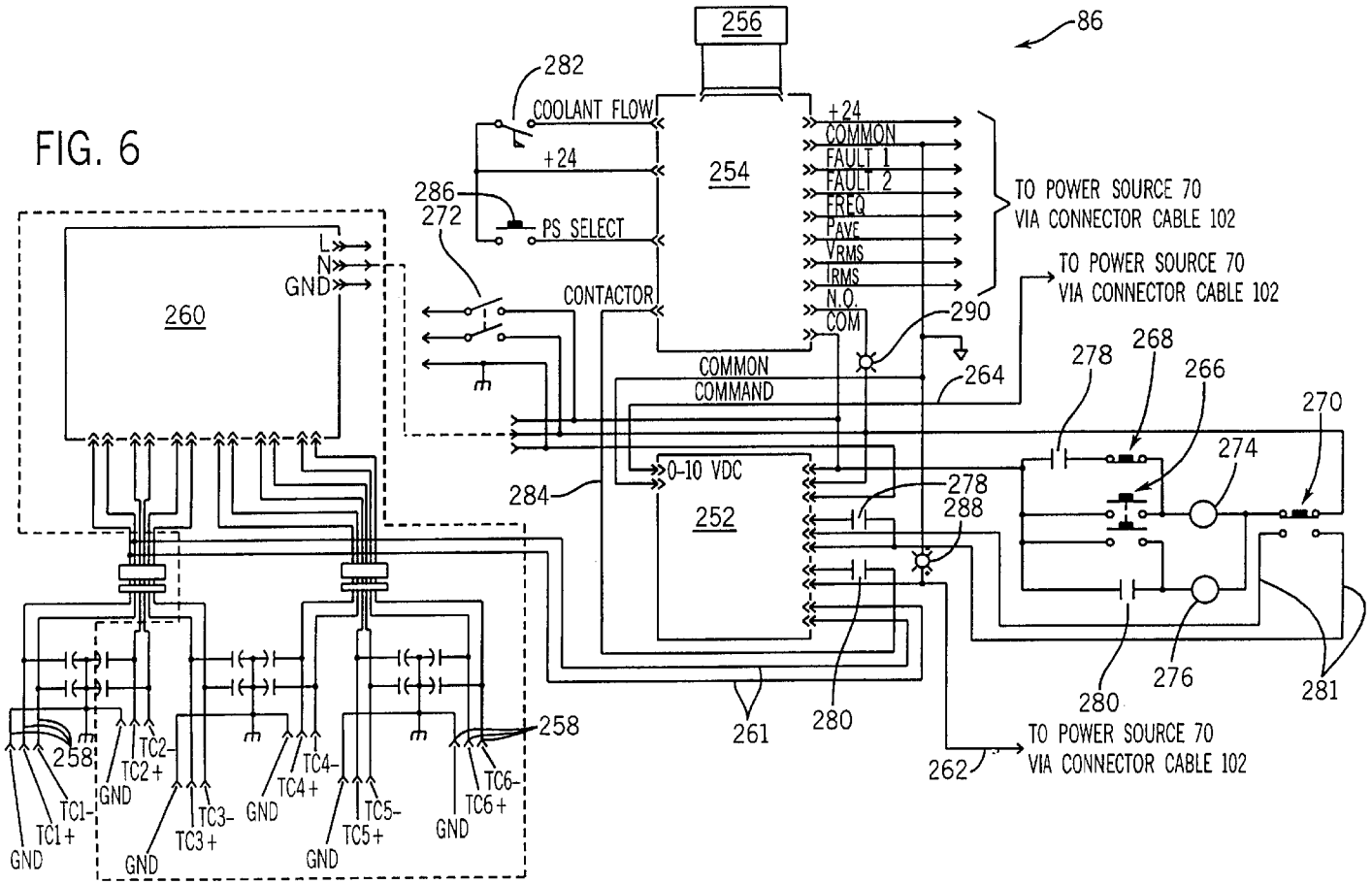
FIG. 6 is an electrical schematic of a controller, according to an exemplary embodiment of the present technique.
Figure 7:
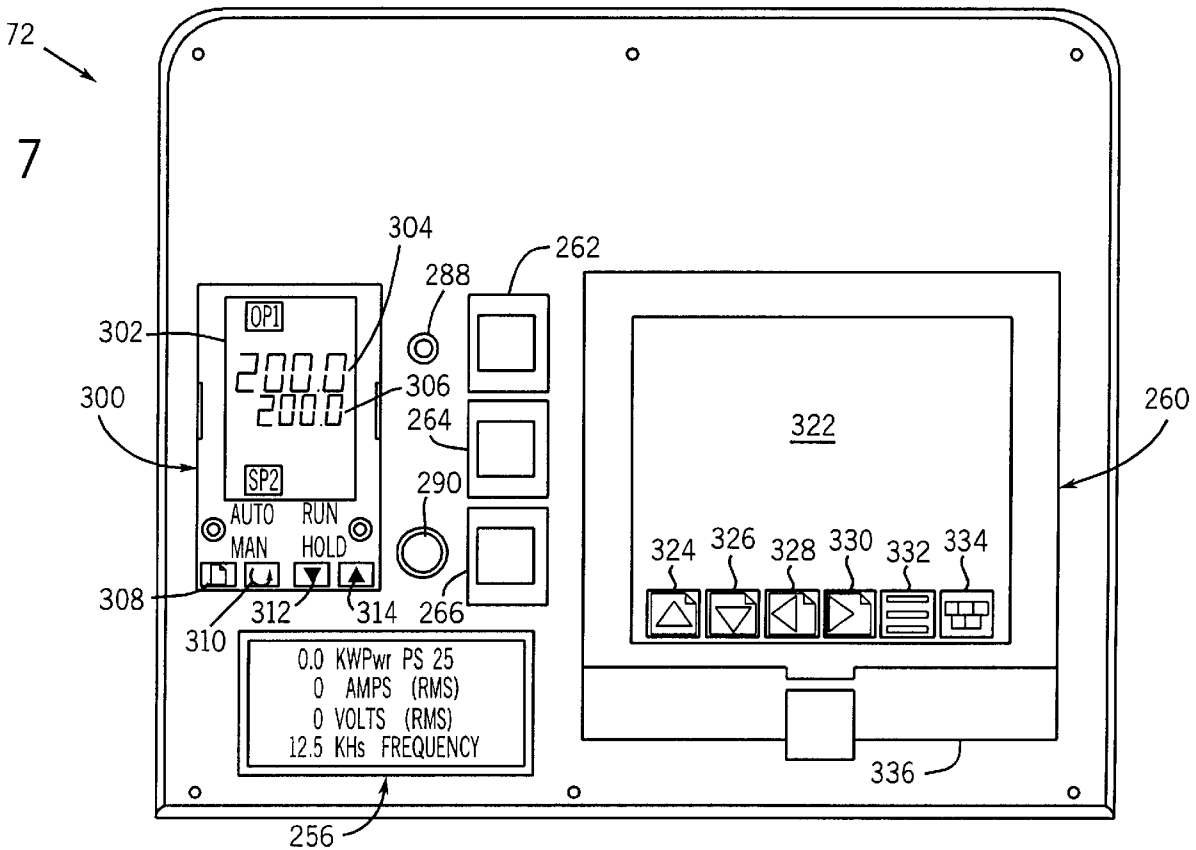
FIG. 7 is a front elevational view of a controller, according to an exemplary embodiment of the present technique.

Referring generally to FIGS. 6 and 7, the system 50 may be controlled automatically by the controller 72. The controller 72 has control circuitry 86 that enables the system 50 to receive programming instructions and control the operation of the power source 70 in response to the programming instructions and data received from the power source 70 and temperature feedback device 60. In the illustrated embodiment, the control circuitry 86 comprises a control unit 252, an I/O unit 254, a parameter display 256, and a plurality of electrical switches. Connection jacks 258 are provided to enable the temperature feedback device 60 to be electrically coupled to the controller 72 and to a data recorder 260. At least one temperature feedback device 60 is coupled through the jacks 258 to the control unit 252 via a pair of conductors 261 so as to provide a DC voltage representative of temperature to the control unit 252. Additional jacks 258 are provided to enable a plurality of temperature feedback devices to be coupled to the data recorder 260. The data recorder 260 may be adapted to record operating parameters, as well. Preferably, the data recorder 260 is a digital device operable to store and transmit data electronically. Alternatively, the controller 72 may have a paper recorder, or no recorder at all.

The control unit 252 is pre-programmed with operational control instructions that control how the control unit 252 responds to the programming instructions. There are a number of control schemes that may be used to control the application of heat to the workpiece. An on-off controller maintains a constant supply of power to the workpiece until the desired temperature is reached, then the controller turns off. However, this can result in temperature overshoots in which the workpiece is heated to a much higher temperature than is desired. In proportional control, the controller controls power in proportion to the temperature difference between the desired temperature and the actual temperature of the workpiece. A proportional controller will reduce power as the workpiece temperature approaches the desired temperature. The magnitude of overshoots is lessened with proportional control in comparison to on-off controllers. However, the time that it takes for the workpiece to achieve the desired temperature is increased. Other types of control schemes include proportional-integral control and proportional-derivative control. Preferably, the control unit 252 is pre-programmed as a proportional-integral-derivative (PID) controller. The integral term provides a positive feedback to increase the output of the system near the desired temperature. The derivative term looks at the rate of change of the workpiece temperature and adjusts the output based on the rate of change to prevent overshoot. Accordingly, the control unit 252 may comprise a processor and memory, such as RAM.

The control unit 252 provides two output signals to the power source 70 via the connector cable 102. The power source 70 receives the two signals and operates in response to the two signals. The first signal is a contact closure signal 262 that energizes contacts in the power source 70 to enable the power source 70 to apply power to the induction heating cable 56. The second signal is a command signal 264 that establishes the percentage of available power for the power source 70 to apply to the induction heating cable 56. The voltage of the command signal 264 is proportional to the amount of available power that is to be applied. The greater the voltage of the command signal 264, the greater the amount of power supplied by the power source. In this embodiment, a variable voltage was used. However, a variable current may also be used to control the amount of power supplied by the power source 70.

In the illustrated embodiment, the electrical switches that provide signals to the control unit 252 include a run button 266, a hold button 268, and a stop button 270. In addition, a power switch 272 is provided to control the supply of power to the controller 72. The run button 266 directs the control unit 252 to begin operating in accordance with the programming instructions. When closed, the run button 266 couples power through the power switch 272 to the control unit 252. In addition, a first relay 274 and a second relay 276 are energized. When energized, the first relay closes first contacts 278 and the second relay 276 closes second contacts 280. The relays and contacts maintain power coupled to the control unit 252 after the run button 266 is released.

The hold button 268 stops the timing feature of the controller 72 and directs the control unit 252 to maintain the workpiece at the current target temperature. The hold button 268 enables the system 50 to continue operating while new programming instructions are provided to the controller 72. When operated, the hold button 268 opens, removing power from the first relay 274 and opening the first contacts 278. This directs the controller to remain at the current point in the heating cycle so that the heating cycle begins right where it was in the cycle when operation returns to normal. Additionally, the second relay 276 remains energized, maintaining the second contacts 280 closed to allow the power supply to continue to provide power to the induction heating coil 56. The run button 266 is re-operated to redirect the control unit 252 to resume operation in accordance with the programming instructions. When re-operated, the first relay 274 is re-energized and the first contacts 278 are closed.

The stop button 270 directs the control unit 252 to stop heating operations. As the stop button 270 is operated, power is removed from both the first and second relays, opening the first and second contacts and removing power from the power source contactors. In the illustrated embodiment, a circuit 281 is completed when the stop button 270 is fully depressed. The circuit 281 directs the control unit 252 to be reset to the first segment of the heating cycle.

The I/O unit 254 receives data from the power source 70 and couples it to the control unit 252 and/or the parameter display 256. The data may be a fault condition recognized by the power source 70 or various operating parameters of the power source 70, such as the voltage, current, frequency, and power of the signal being provided by the power source 70 to the flexible inductive heating cable 56. The I/O unit 254 receives the data from the power source 70 via the connector cable 102.

In the illustrated embodiment, the I/O unit 254 also receives an input from a flow switch 282. The flow switch 282 is closed when there is adequate cooling flow returning from the flexible inductive heating cable 56. When fluid flow through the flow switch 282 drops below the required flow rate, flow switch 282 opens and the I/O unit 254 provides a signal 284 to the control unit 252, causing the control unit 252 to direct the power source 70 to discontinue supplying power to the induction heating cable 56. Additionally, the flow switch 282 is located downstream, rather than upstream, of the flexible inductive heating cable 56 so that any problems with coolant flow, such as a leak in the flexible inductive heating cable 56, are detected more quickly. A power source selector switch 286 is provided to enable a user to select the appropriate maximum available power of the power source. For example, the absolute maximum power that a power source may provide may be 50 KW. The power selector switch 286 may be operated to establish a lower output power, 25 KW for example, as the maximum available power.

The controller 72 also has a plurality of visual indicators to provide a user with information. One indicator is a heating light 288 to indicate when current is being applied to the fluid-cooled induction heating cable 56. Another indicator is a fault light 290 to indicate to a user when a problem exists. The fault light may be lit when there is an actual fault, such as a loss of coolant flow, or when an operational limit has been reached, such as a power or current limit.

Referring generally to FIG. 7, the control unit 252 is programmed from the exterior of the controller 72. In addition, the exterior of the controller 72 has a number of operators and indicators that enable a user to operate the system 50. For example, the control unit 252 has a temperature controller 300 that enables a user to input programming instructions to the control unit 252. The illustrated temperature controller 300 has a digital display 302 that is operable to display programming instructions that may be programmed into the system 50. In the illustrated embodiment, the digital display 302 is operable to display both the actual workpiece temperature 304 and a desired temperature 306 that has been programmed into the system 50. The digital display 302 may also display other temperature information, such as the actual rate that the workpiece 52 is changing temperature and a desired programmed rate of temperature change. The illustrated temperature controller 300 has a page forward button 308, a scroll button 310, a down button 312, an up button 314, an auto/man button 316, and a run/hold button that are used to program and operate the system 50. To program the control unit 252, the page forward button 308 is operated until a programming list is displayed.

Figure 8:
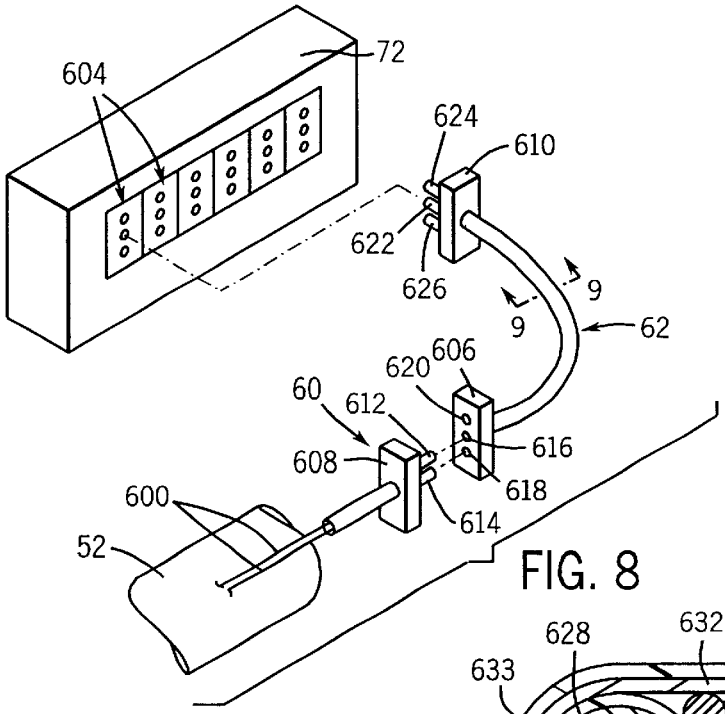
FIG. 8 is a view of a thermocouple connected to a controller by a shielded extension cable.

Referring generally to FIG. 8, the system is adapted to reduce the level of noise in the electrical signals received from a temperature feedback device 60. Typically, the temperature feedback device 60 is a thermocouple. However, other types of temperature feedback devices may be used, such as an RTD (resistance-temperature-detector) bridge circuit. The thermocouple wires 600 may be tack welded onto the workpiece 52 to secure them in position. In the illustrated embodiment, an extension 602 is used to couple the thermocouple wires 602 from the workpiece 52 to one of a plurality of electrical connectors 604 on the rear of the controller 72. In the illustrated embodiment, the extension 602 has a receptacle end 606 that is adapted to matingly engage a connector portion 608 of the thermocouple 60. The extension has a plug end 610 opposite the receptacle end 606 that is adapted to matingly engage one of the electrical connectors 604.

The connector portion 608 of the thermocouple 60 has a positive prong 612 and a negative prong 614. A DC voltage proportional to temperature is produced at the junction of the thermocouple wires 600 and transmitted to the two prongs of the connector portion 608. In the illustrated embodiment, the receptacle end 606 of the extension 62 has three jacks: a positive voltage jack 616, a negative voltage jack 618, and a ground jack 620. The positive voltage jack 616 is adapted to receive the positive prong 612 and the negative voltage jack 618 is adapted to receive the negative prong 614. The plug end 610 of the extension 602 has three prongs: a positive voltage prong 622, a negative voltage prong 624, and a ground prong 626.

Figure 9:
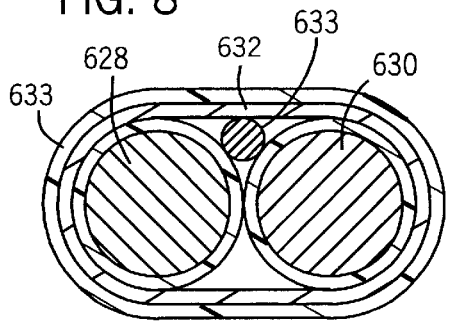
FIG. 9 is a cross-sectional view of the shielded extension cable, taken generally along line 8—8 of FIG. 8

As best illustrated in FIG. 9, the extension cable 602 has a first insulated conductor 628 and a second insulated conductor 630. The first insulated conductor 628 electrically couples the positive voltage prong 622 to the positive voltage jack 616. The second insulated conductor 630 electrically couples the negative voltage prong 624 to the negative voltage jack 618. A conductive shield 632 surrounds each of the first and second insulated conductors. A drain wire 633 is coupled to the conductive shielding 632. The drain wire 633 electrically couples the ground prong 626 to the ground jack 620. The ground jack 620 of the extension 602 enables the shielding 632 in one extension 602 to be electrically coupled to the shielding 632 in another extension 602 when a plurality of extensions 602 are connected together. Additionally, rather than a separate shielded extension, a thermocouple wire having shielding extending along a portion of its length may also be used. Insulation 633 is provided over the shielding 632.

Referring generally to FIGS. 6 and 8, each electrical connector 604 on the controller 72 has three jacks 258: a positive voltage jack 640, a negative voltage jack 642, and a ground jack 644. When the extension 602 is inserted into the electrical connector 604, the positive voltage prong 622 of the extension 602 is inserted into the positive voltage jack 640 of the electrical connector 604, the negative voltage prong 624 is inserted into the negative voltage jack 642, and the ground prong 626 is inserted into the ground jack 644. When the thermocouple 60 is inserted directly into the electrical connector 604, the positive voltage prong 612 of the thermocouple 600 is inserted into the positive voltage jack 640 of the electrical connector 604 and the negative voltage prong 614 of the thermocouple 600 is inserted into the negative voltage jack 642 of the electrical connector 604.

As best illustrated in FIG. 6, the positive voltage jacks 640 and the negative voltage jack 642 of each of the electrical connectors 604 are electrically coupled through a first ferrite 646 and a second ferrite 648. The first and second ferrites prevent erroneous readings and/or damage to the recorder 260 and control unit 252 due to voltage spikes picked up by the thermocouple 60 or extensions. In addition, each positive voltage jack 640 and each negative voltage jack 642 is electrically coupled to ground 650 through a capacitor 652. The capacitors 652 are selected to have a low impedance to AC signals at noise frequencies. Preferably, the capacitors are selected to have a low impedance at radio frequencies, i.e., the operating frequency of the electricity flowing through the induction heating cable. The low impedance of the capacitors 652 at noise frequencies results in the electrical noise being shunted through the capacitors 652 to ground 650. Thus, the electrical noise does not continue on to the recorder 260 and control unit to interfere with data recordation and control of the system 50. In addition, the capacitors 652 block the DC voltage produced by the thermocouples 60. Thus, the DC voltage from the thermocouples 60 is not shunted to ground 650 but continues on to the recorder 260 and control unit 252. Additionally, each of the ground jacks 644 are electrically coupled to ground 650; thereby grounding the shielding conductor 632. Therefore, any electrical noise picked up by the shielding conductor 632 is electrically coupled to ground 650.

Figure 10:
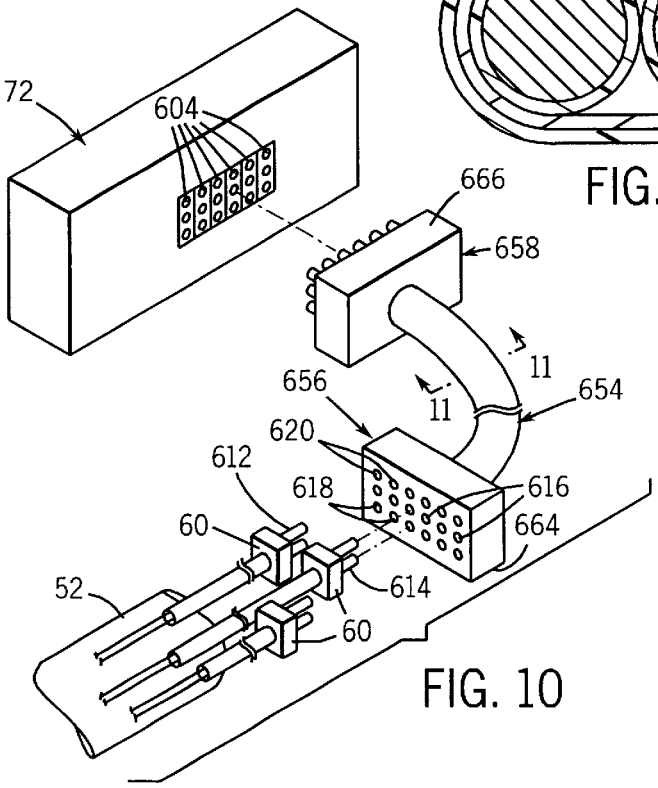
FIG. 10 is a view of a plurality of thermocouples connected to a controller by a shielded multi-thermocouple extension cable.

Referring generally to FIG. 10, in certain applications, the temperature of the workpiece 52 may vary from top to bottom due to convection heat losses. Therefore, a more accurate indication of the temperature of the workpiece 52 may be achieved by placing a number of temperature feedback devices 60 at various locations around the workpiece 52, including the inside of the workpiece 52. In the illustrated embodiment, a multiple extension 654 is used to couple a plurality of temperature feedback devices 60 to the electrical connectors 604 on the rear of the controller 72.

The multiple extension 654 has a female connector assembly 656 at one end that is electrically coupled through the multiple extension 654 to a male connector assembly 658 at the opposite end of the multiple extension 654. The female connector assembly 656 has a plurality of positive voltage jacks 616, negative voltage jacks 618, and ground jacks 620 to enable the multiple extension 654 to electrically couple a plurality of thermocouples 60. The positive voltage jacks 616 are adapted to receive the positive prongs 612 and the negative voltage jacks 618 are adapted to receive the negative prong 614. The male connector assembly 658 has a plurality of positive voltage prongs 622, negative voltage prongs 624, and ground prongs 626 to enable the male connector assembly 658 to connect to a plurality of connector assemblies 604 on the controller 72.

As best illustrated in FIG. 11, the multiple extension 654 has a plurality of sets of insulted conductors 660. In this embodiment, each of the sets of insulted conductors 660 is constructed similarly to the extension cable 602. Each set of insulted conductors electrically couples one temperature feedback device 60 to the controller 72. The shielding 632 in one set of conductors 660 is electrically isolated from the shielding 632 in the other sets of conductors 660 so that noise is not transmitted between the sets of conductors 660. Additionally, in the illustrated embodiment, a separate shielding conductor 662 is wrapped around all of the sets of conductors 660. An overall drain wire 663 is coupled to the separate shielding conductor 662. The overall drain wire 663 is electrically coupled to the housing 664 of the female connector assembly 656 and the housing 666 of the male connector assembly 658.

It will be understood that the foregoing description is of preferred exemplary embodiments of this invention, and that the invention is not limited to the specific forms shown. For example, the noise reduction system may be used to reduce the noise from temperature feedback devices other than thermocouples, such as an RTD. Additionally, the specific configuration of the electrical connectors, i.e., male or female, may be changed without altering the features of the system. These and other modifications may be made in the design and arrangement of the elements without departing from the scope of the invention as expressed in the appended claims.

What is claimed is:

1. An induction heating system, comprising:

a power source;

an induction heating device that is electrically coupleable to the power source to produce a varying magnetic field;

a control circuit operable to control the application of electrical power from the power source to the induction heating device;

a temperature feedback device having a plurality of conductors; and an interface operable to electrically couple the plurality of conductors to the control circuit and to ground through at least one capacitor.

2. The system as recited in claim 1, wherein the temperature feedback device is a thermocouple.

3. The system as recited in claim 1, comprising an extension cable for coupling the temperature feedback device to the control unit, the extension cable comprising a shield conductor surrounding the plurality of conductors, the shield conductor being electrically coupled to ground by the interface.

4. The system as recited in claim 3, wherein the extension cable is operable to couple a plurality of temperature feedback devices to the control unit.

5. The system as recited in claim 4, wherein the extension cable comprises a plurality of conductor sets, each conductor set being adapted to electrically couple a temperature feedback device to the controller, wherein each conductor set is surrounded by a shield conductor.

6. The system as recited in claim 1, wherein the temperature feedback device produces a DC signal and the at least one capacitor is adapted to pass AC signals to ground.

7. The system as recited in claim 1, comprising an inductor, wherein the interface is electrically coupled to the control circuit via the inductor.

8. The system as recited in claim 1, wherein the at least one capacitor is adapted to couple radio frequency signals to grounds.

9. The system as recited in claim 1, wherein the interface is operable to electrically couple a plurality of temperature feedback devices to a recorder.

10. An induction heating system, comprising:

a power source;

an induction heating device that is electrically coupleable to the power source to produce a varying magnetic field;

a temperature feedback device;

an extension cable for the temperature feedback device, the extension cable having conductive shielding; and an interface operable to electrically couple the conductive shielding to ground.

11. The system as recited in claim 10, wherein the interface comprises an a first electrical connector adapted for mating engagement with a second electrical connector on the extension cable, the first and second electrical connectors having a separate connector element for coupling the conductive shielding.

12. A method of reducing electrical noise from a temperature signal received by an induction heating system from a temperature feedback device, comprising:

providing the induction heating system with an interface having a capacitive circuit coupled to ground; and establishing the capacitance of the capacitive circuit to shunt electrical noise to ground.

13. The method as recited in claim 12, wherein establishing comprises establishing the capacitive circuit with a capacitance that results in radio frequency signals being shunted to ground.

14. The method as recited in claim 12, wherein adapting comprises establishing the capacitive circuit with a capacitance to allow AC signals to pass through the capacitive circuit to ground.

15. A method of reducing electrical noise from an electrical signal produced by a temperature feedback device, comprising:

connecting the temperature feedback device to an induction heating system using a shielded extension cable having a plurality of conductors adapted to electrically couple the temperature feedback device to the induction heating system and a shielding conductor surrounding the plurality of conductors; and coupling the shielding conductor in the shielded extension cable to electrical ground.

16. The method as recited in claim 15, wherein connecting comprises adapting the electronic device with an first electrical connector adapted to matingly engage a second electrical connector electrically coupled to the shielding conductor.

17. The method as recited in claim 16, wherein connecting comprises connecting the shielded extension cable to the induction heating system via a second shielded extension cable, the second extension being operable to electrically couple the shielding conductor of the shield extension cable to the induction heating system.

18. A method of reducing electrical noise from a temperature signal received by an electronic circuit from a temperature feedback device, comprising:

providing the electronic circuit with an interfere having a capacitive circuit coupled to ground; and establishing the capacitance of the capacitive circuit to shunt electrical noise produced by a magnetic field to ground.

19. The system as recited in claim 18, wherein establishing comprises establishing the capacitance of the capacitive circuit to shunt to ground electrical noise at the frequency of the electric current producing the magnetic field.

* * * * *